United States Patent [19]

Byrns

[11] Patent Number: 4,708,254

[45] Date of Patent: Nov. 24, 1987

[54] INSULATED BOTTLE HOLDER

[76] Inventor: James E. Byrns, 1027 2nd Ave. South, Clinton, Iowa 52732

[21] Appl. No.: 925,276

[22] Filed: Oct. 31, 1986

[51] Int. Cl.[4] ..... B65D 23/08

[52] U.S. Cl. ..... 215/13.1; 215/100 R; 220/85 H; 220/903

[58] Field of Search ..... 215/12 A, 13 R, 100 R, 215/12 R; 150/52 R; 220/903, 85 H, 408, 412; 62/457, 372; 248/346, 359 E

[56] References Cited

U.S. PATENT DOCUMENTS

| | | | |
|---|---|---|---|
| 2,563,508 | 8/1951 | Anschicks | 215/13 R |
| 2,685,319 | 8/1954 | Swasko | 150/52 R |
| 2,881,936 | 4/1959 | Piker | 215/13 R |
| 3,299,442 | 1/1967 | White et al. | 215/100 R X |
| 3,403,714 | 10/1968 | Mulm | 215/12 R X |
| 3,473,682 | 10/1969 | Studen | 150/52 R X |
| 3,868,036 | 2/1975 | Wittwer | 215/12 R |
| 4,510,769 | 4/1985 | McClellan, Jr. | 62/457 |
| 4,534,391 | 8/1985 | Ventimiglia | 150/52 R |
| 4,549,410 | 10/1985 | Russell | 215/13 R X |

FOREIGN PATENT DOCUMENTS

| | | | |
|---|---|---|---|
| 1450735 | 8/1966 | France | 215/13 R |

*Primary Examiner*—William Price
*Assistant Examiner*—Sue A. Weaver
*Attorney, Agent, or Firm*—Thomas J. Greer, Jr.

[57] ABSTRACT

An insulated bottle holder defined by an outer shell of a moldable, resilient plastic material and an inner, removable insulating liner inside of a lower, cylindrical portion of the outer shell. The uppermost portion of the shell is conical, being truncated and flat at its top, the flat top defined by a deformable wall having a bottle ring engaging opening. A bottle is inserted into the open bottom of the holder and is pushed upwardly until the bottle threads and ring pass through and extend slightly beyond the opening in the deformable wall. The periphery of the top opening releasably holds the bottle in the bottle holder by snugly engaging the neck of the bottle just below the ring, the ring abutting the upper periphery of the top opening in the deformable wall. Friction between the bottle and the liner also holds the bottle in the holder shell. The bottle is removed by forcing it downwardly against the deformable wall.

8 Claims, 3 Drawing Figures

FIG. 1
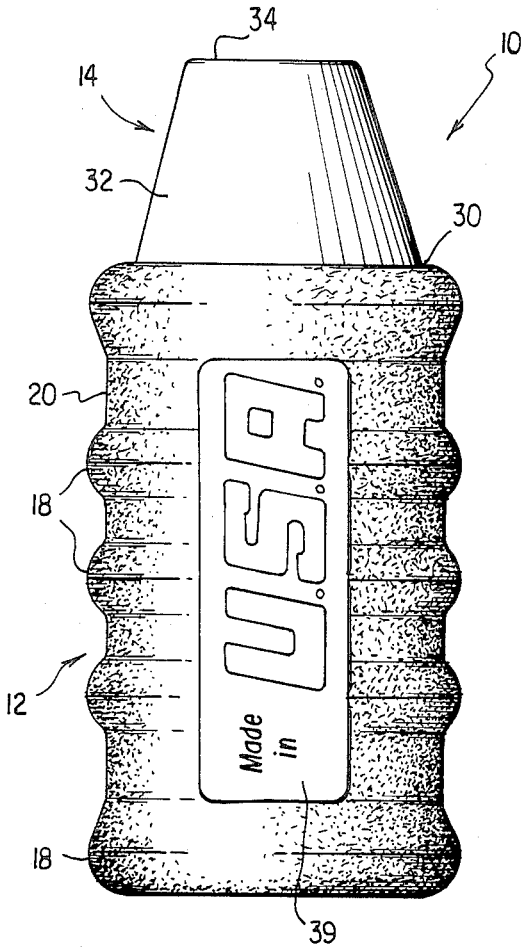
FIG. 2
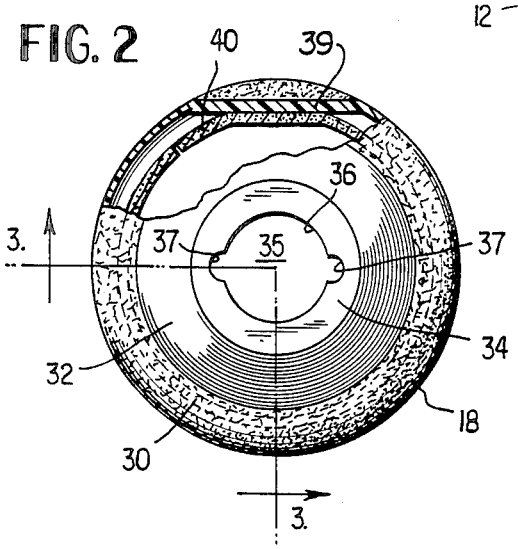
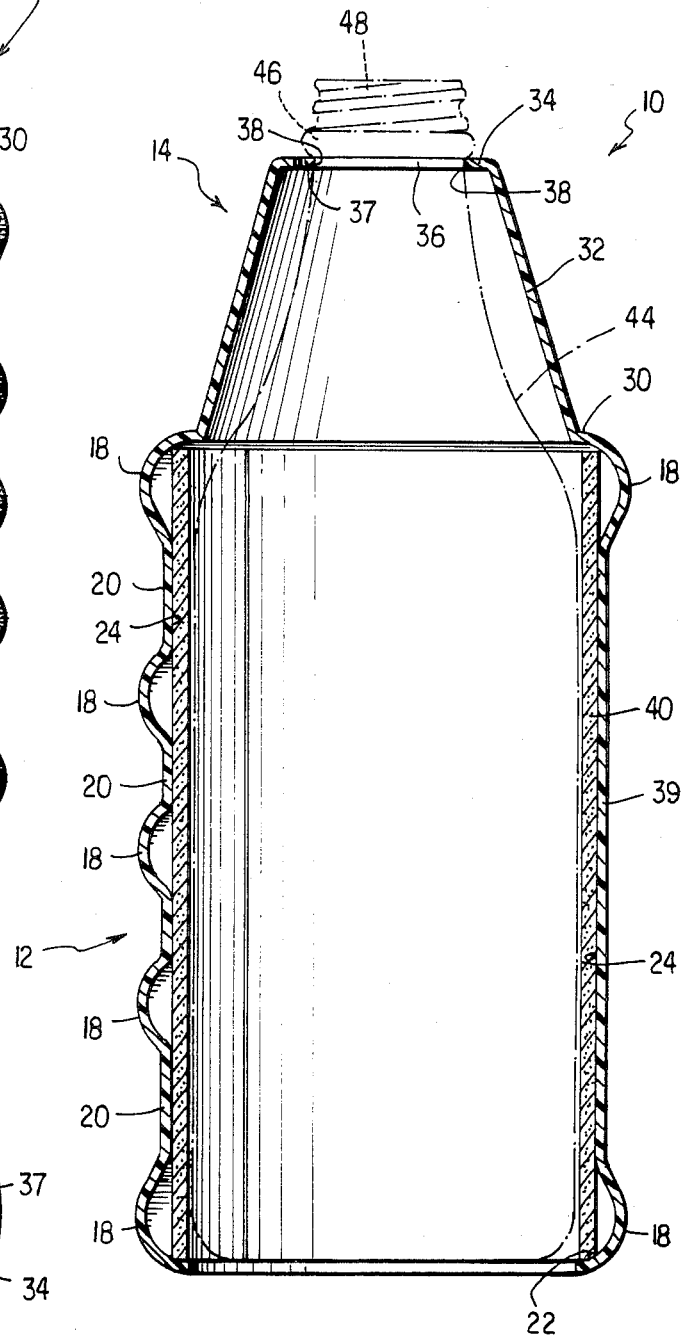
FIG. 3

INSULATED BOTTLE HOLDER

BACKGROUND OF THE INVENTION

This invention relates to an insulated bottle holder of the type adapted to thermally insulate a glass bottle to thereby maintain the bottle and its contents at a below ambient temperature. Such bottle insulators are placed around a cooled bottle after it has been taken from a refrigerator.

SUMMARY OF THE INVENTION

According to the practice of this invention, a thermally insulated bottle holder is fashioned from a moldable plastic material, such as low density polyethylene, the holder being in the general form of a cylinder having a tapered conical top or upper integral extension, the extension having an aperture or opening to receive an engage the upper end of a bottle. The lower end of the bottle holder is open to thereby enable the insertion and the removal of a bottle. The cylindrical portion contains a removable insulating liner, the latter being in the general form of a rectangular sheet of a closed cell polyethylene sheet bent end to end to a generally cylindrical form so as to conform to the generally circular inner sides of the main or lower portion of the holder. The bottle, conventionally, carries a ring located below the screw threads, the ring engaging the upper periphery of the opening through which the bottle screw threads and ring extend. This abutment establishes a support for the bottle such that when the holder is lifted upwardly, the bottle will not fall out. Insertion of the bottle into the holder is effected by pushing it in, to thereby distort or bend the upper opening, the extent of the insertion being such that the ring of the bottle extends slightly beyond the periphery of the opening and will come to rest against the upper periphery of the opening at the conclusion of the insertion process. For removal, the bottle is pushed downwardly to again distort the opening, so that the ring of the bottle may now pass through the opening. The cylindrical portion of the container is provided with a plurality of horizontally extending ridges, to thereby define ridges and valleys and enhance the ease with which the holder may be grasped by the fingers. Further, one or more flat portions are provided on the cylindrical portion of the holder, extending generally vertically and interrupting the ridges, to thereby facilitate the display of indicia, such as advertising indicia, on the bottle holder. The interior surfaces of the flat, indicia bearing portions extend radially inwardly somewhat so as to give the insulating liner a slightly elliptical shape. The narrowmost portions of the insulating liner frictionally grip the bottle exterior to thereby define additional support for the bottle. The closed cell insulating liner may be removed for cleaning or for replacement.

BRIEF DESCRIPTION OF THE DRAWINGS

FIG. 1 is a side elevational view of the holder.

FIG. 2 is a top plan view with parts broken away.

FIG. 3 is a sectional view taken along section 3—3 of FIG. 2.

DESCRIPTION OF THE INVENTION

Referring now to the drawings, the numeral 10 denotes generally the insulated bottle holder of this invention and it includes a shell formed from a moldable resilient thermoplastic material, such as low density polyethylene, and having a generally cylindrical, main lower portion 12 integrally secured to an upper, generally tapering or truncated conical portion 14.

The lower and generally cylindrical portion of the outer shell includes four ridges denoted by the numeral 18, the spaces between the ridges defining valleys denoted by the numeral 20. The valleys 20 facilitate engagement of the lower cylindrical portion by the fingers of the user. The numeral 22 denotes the lowermost portion of the shell, the shell being open at its bottom. The diameter of the bottom opening, at lower portion 22, is slightly larger than the diameter of a bottle which is to be inserted into the holder, and is slightly smaller than the diameter of an insulating liner, shortly to be described. The numeral 24 denotes the interior surface of the lower portion 12, at flat portions 39 the latter to be described. The numeral 30 denotes the uppermost portion of the cylindrical part 12 of the shell, portion 30 extending generally horizontally and defining an upper abutment for the insulating liner.

The numeral 32 denotes the wall of the upper, truncated conical portion of the shell, this portion terminating in a horizontally extending wall portion 34, the latter having an opening 35 therein, with the upper peripheral surface or rim immediately adjacent to the opening being denoted by the numeral 36. The numeral 38 denotes a bevel across the thickness of wall potion 34 at the rim of the opening. The bevel slants radially inwardly in passing upwardly. The numeral 39 denotes either one of two flat, indicia bearing portions on opposite sides of the lower holder portion 12. As indicated at FIG. 2, these flat portions, or flats, engage the liner 40 (to be described) to give the liner a slightly elliptical shape in transverse cross section.

The numeral 40 denotes an insulating liner, originally rectangular in shape, and fashioned from closed cell polyethylene. The upper portion of liner 40 is adjacent abutment 30, while its lower portion or rim is supported by portion 22 of the shell. Insulating liner 40 has an internal memory or bias and hence tends to remain flattened, in its original, planar configuration, so that when it is inserted into the shell, it exhibits a tendency to move radially outwardly and firmly abut against the interior surfaces 24 of the cylindrical shell portion 12. The inner diameter of liner 40 is substantially the same size or slightly less than the external diameter of the glass bottle.

The numeral 44 denotes a glass bottle having the usual lower cylindrical portion with a tapered neck portion, the latter including an integral ring or bead 46, the uppermost and external portion of the bottle having the usual screw threads denoted by the numeral 48.

The operation of the insulated bottle holder of this invention is as follows. With the insulating liner 40 having been inserted into the interior of the lower portion 14 of the holder, the bottle is then pushed upwardly until its upper rim strikes beveled portion 38 of opening 35. Bevel 38 functions as a guide for the bottle top. The bevel is in a direction to make bottle withdrawal more difficult than bottle insertion. At this point, some resistance to continued upward motion of the bottle relative to the holder 10 is encountered. However, due to the flexibility of wall portion 34, and also due to the presence of diametrically opposite recesses 37 adjacent periphery 36 of the top opening, wall portion 34 deforms sufficiently enough to permit the passage of the upper portion of the bottle completely through the opening, until the bottle assumes the position indicated at FIG. 1, or slightly above that position, relative to the outer shell of the holder. At this position, as shown at FIG. 1, the upper peripheral surface 36 of opening 35 is in bearing and supporting contact with respect to the lower peripheral portion of integral ring 46 of the bottle, with the result that the bottle is supported against downward movement relative to the bottle holder. The thinness of the rim of opening 35, due to bevel 38, assists in producing a tight fit on the neck of the bottle. The slightly elliptical shape of the liner 40, due to interior surfaces 24 of flats 39 abutting it, provides a degree of friction with the bottle, to further support the bottle against downward movement relative to the holder.

After the user consumes the liquid contents of bottle 44, the bottle is removed from the container by reversing the action attendant its insertion, namely the lower portion 12 of the holder is grasped in one hand and the other hand pushes down of the uppermast part of the bottle, to again cause distortion and bending of wall portion 34, with the result that the bottle can now be removed from the holder.

The function of insulating liner 40 has been stated to enhance thermal isolation of the bottle from ambient, to thereby assist in maintaining the temperature of the bottle and its contents below ambient. Additionally, the closed cell, low density polyethylene material employed for liner 40 functions to protect the bottle from vibration and shock. In order to remove liner 40, it is only necessary to grasp an edge of one of its corners near the bottom opening of the bottle holder and pull to thereby distort the liner and remove it. For insertion, the liner is rolled from its flat form to assume a tubular form, and then inserted into the lower cylindrical portion 12, and it expands to its indicated configuration.

Lower abutment 22 inhibits the pulling out of liner 40 from the holder when a bottle is removed, the friction between the bottle and liner urging the liner downward. During bottle insertion, the horizontal wall 30 defines an abutment to prevent extreme upward movement and distortion of the liner, also due to friction between the bottle and the liner.

The exterior surface of cylindrical portion, including rings 18, is textured to give a rough surface and thereby facilitate holding with the hand. The rings 18 and depressions 20 additionally function to give a corrugated construction and thereby impart structural integrity. Additionally, the corrugating effect permits the holder to accommodate some bottle diameter variations by slightly changing diameter, as required.

While glass bottle 44 is shown as having the usual integral ring 46 thereon, there may be a certain bottles which are not so provided. In those cases, the relatively sharp edge defined by slanted or beveled surface 38 and flat wall surface 34 provides a tight fit with the upper portion of the neck of the bottle just below the threads 48, or with the threads themselves. Thus, because of the thinness of wall 34 at the periphery 36 of upper opening 35, the threads alone, for those bottles which have no integral ring 46, may be engaged. Further, from a consideration of FIGS. 1 and 2, it will seen that the diameter of the upper opening 35 of conical portion 14 is smaller than the outer diameter of the threads 48 and ring 46, while the maximum distance between openings or recesses 37 is greater than the outside diameter of threads 48 and ring 4. This arrangement facilitates both the insertion and the removal of the bottle from this holder. Flat portions 39, in the manufacture of the holder, may be formed slightly towards or slightly away from the holder interior, to thereby slightly vary the degree of eccentricity of the elliptical cross sectional shape of liner 40 and thus more readily accomodate bottles of specific manufacturers which may be of slightly different diameters.

Both the shell and insulating liner are fashioned from F.D.A. approved materials, approved for food packaging. A child could chew on the shell of the liner with no harmful effects. Further, the toughness of the material would make it very difficult to bite off a piece.

The terms upper, lower, longitudinal and transverse are used to facilitate the description of the invention and are not to be construed as limiting terms.

I claim:

1. A thermally insulated bottle holder adapted to hold a cooled glass bottle and maintain it at a temperature below ambient, the bottle holder including a one piece shell formed from a moldable and resilient plastic material, the shell having a lower, generally cylindrical portion having an inner wall surface and an outer wall surface and a hollow upper, truncated, generally conical portion, the lower portion having a lower opening at its bottom, the upper portion terminating in a horizontal wall, an upper opening through said horizontal wall adapted to receive the upper end of a bottle, and a thermally insulating liner of generally cylindrical shape being in surface contact with the inner wall surface of the cylindrical portion, the horizontal wall portion of the truncated conical portion being resiliently deformable when distorted to thereby define means for receiving and holding the upper portion of a bottle, said horizontal wall portion and said liner defining the means for supporting a bottle with no structure of the holder contacting the bottom surface of the bottle.

2. The bottle holder of claim 1 wherein the sides of said cylindrical portion are provided with spaced ridges to thereby define spaced valleys therebetween, the ridges extending at least partially around the circumference of the cylindrical portion, whereby the cylindrical portion can vary slightly in diameter to thereby accommodate bottles of slightly different diameter and whereby the valleys define recesses for the fingers of a user.

3. The bottle holder of claim 2 including at least one flat surface on said inner and outer surfaces of the cylindrical portion and extending longitudinally of the cylindrical portion and interrupting said ridges and valleys, the inner portion of said flat surface forming a portion of the inner wall surface of said cylindrical portion and contacting said insulating liner to cause said liner to assume a non-circular cross-sectional shape.

4. The bottle holder of claim 1 wherein the inner peripheral surface adjacent the bottom opening of said cylindrical portion defines an abutment for the lower and of said insulating liner to thereby inhibit the pulling out of the liner from the bottle holder when a bottle is removed from the bottle holder.

5. The bottle holder of claim 1 wherein the uppermost portion of said cylindrical portion carries a horizontal wall portion which defines an abutment for the upper end of said insulating liner to thereby inhibit extreme upward movement and distortion of the liner during insertion of a bottle into the bottle holder.

6. The bottle holder of claim 1 wherein the edge of said upper opening in the horizontal wall of said upper, truncated conical portion is beveled, to thereby define a peripheral edge of lesser thickness than that of said horizontal wall, the bevel slanting radially inwardly in passing upwardly.

7. The bottle holder of claim 1 wherein the peripheral edge of said upper opening in the horizontal wall of said upper, truncated conical portion is provided with at least one recess extending outwardly whereby said horizontal wall more readily deforms to permit insertion and withdrawal of the upper portion of a bottle.

8. The bottle holder of claim 7 wherein there are two of said recesses, the said two recesses being diametrically opposed.

* * * * *